US007900301B2

(12) United States Patent
Tatsuno

(10) Patent No.: US 7,900,301 B2
(45) Date of Patent: Mar. 8, 2011

(54) WOVEN FABRIC PRODUCT

(75) Inventor: Isamu Tatsuno, Osaka (JP)

(73) Assignee: Mont-Bell Co., Ltd., Osaka (JP)

( * ) Notice: Subject to any disclaimer, the term of this patent is extended or adjusted under 35 U.S.C. 154(b) by 0 days.

(21) Appl. No.: 12/339,420

(22) Filed: Dec. 19, 2008

(65) Prior Publication Data

US 2009/0176428 A1 Jul. 9, 2009

(30) Foreign Application Priority Data

Jan. 7, 2008 (JP) ..... 2008-000445

(51) Int. Cl.
*A41B 13/06* (2006.01)

(52) U.S. Cl. ..... 5/413 R

(58) Field of Classification Search ..... 5/413 R; 442/218, 224, 226, 239, 246, 250, 251, 255, 442/260, 263
See application file for complete search history.

(56) References Cited

U.S. PATENT DOCUMENTS

| | | | | |
|---|---|---|---|---|
| 2,786,734 | A * | 3/1957 | Leach et al. | 8/181 |
| 4,091,482 | A | 5/1978 | Malcolm | |
| 6,800,159 | B2 * | 10/2004 | Itoh | 156/93 |
| 6,955,999 | B1 * | 10/2005 | Boye | 442/205 |

FOREIGN PATENT DOCUMENTS

| | | |
|---|---|---|
| DE | 203 12 523 | 10/2003 |
| FR | 2 742 171 | 6/1997 |
| FR | 2 759 562 | 8/1998 |
| JP | H06-36793 | 9/1994 |
| JP | U 3014810 | 6/1995 |
| JP | H 10-168746 | 6/1998 |
| JP | 2001-46205 | 2/2001 |
| JP | 2001-299537 | 10/2001 |
| JP | 2004-159701 | 6/2004 |
| JP | 2005-194649 | 7/2005 |
| WO | WO 01/30187 | 5/2001 |

OTHER PUBLICATIONS

European Search Report, Application No. EP 09 15 0101, dated May 19, 2009, 7 pages.
English language abstract and machine translation of FR 2742171, Jun. 13, 1997, 3 pages.
English language abstract and machine translation of FR 2759562, Aug. 21, 1998, 3 pages.

* cited by examiner

*Primary Examiner* — Arti Singh-Pandey
(74) *Attorney, Agent, or Firm* — Sterne, Kessler, Goldstein & Fox P.L.L.C.

(57) ABSTRACT

A woven fabric product 1 made of woven fabric pieces cut out of woven fabric into specified shapes and sewn together is provided, wherein the warp and weft directions of weave patterns 200 of the woven fabric are positioned obliquely to the longitudinal direction of the woven fabric piece.

2 Claims, 5 Drawing Sheets

WOVEN FABRIC PRODUCT

CROSS-REFERENCE TO RELATED APPLICATIONS

This application relates to and claims priority from Japanese Patent Application No. 2008-445, filed on Jan. 7, 2008, the entire disclosure of which is incorporated herein by reference.

BACKGROUND

1. Field of the Invention

The invention relates generally to an improvement of a woven fabric product such as a sleeping bag, clothes, or a sleeping bag cover.

2. Description of Related Art

Conventionally, a sleeping bag is an example of a woven fabric product. For example, there is a sleeping bag including: a heat insulating means for defining a long inside space for placing a user's body and keeping the inside space warm; an opening to the inside space, that is made in the heat insulating means; and elastic elements for compressing the heat insulating means in a direction to reduce the cross-sectional area of the inside space; wherein the elastic elements are located at specified intervals along the entire length of the heat insulating means (see, for example, Japanese Utility Model Registration No. 2079863).

There is another type of sleeping bag including: a sleeping bag main body that has an inside woven fabric, an outside woven fabric, and a heat insulating material filled in the space between the inside woven fabric and the outside woven fabric, and that forms a long inside space for placing a user's body, and keeps the inside space warmer than the outside air; and an opening to the inside space that is made in the sleeping bag main body; wherein the sleeping bag main body has the inside woven fabric and the outside woven fabric which are wider than a specified width that fits the constitution of the user's body and which can be contracted to the specified width, when the sleeping bag is not in use, by means of elastic elements placed at appropriate positions; and wherein the sleeping bag main body is configured so that it can expand from the specified width to the wider width, or contract from the wider width to the specified width (see, for example, Japanese Patent Laid-Open (Kokai) Application Publication No. 2001-46205).

Each of the conventional sleeping bags described above is gathered in its widthwise direction so that the sleeping bag will fit the user's body adequately when they wear it, and the sleeping bag can stretch or contract in its widthwise direction in accordance with the user's movement of, for example, turning over in their sleep, or changing their clothes or sitting cross-legged inside the sleeping bag. Therefore, a large amount of cloth (woven fabric) is needed to make the sleeping bag, so the weight and volume of the sleeping bag increase, which is inconvenient in terms of portability and storage.

SUMMARY

The present invention was devised in light of the circumstances described above. It is an object of the invention to provide a woven fabric product whose woven fabric pieces can be stretched in the longitudinal and transverse directions of the woven fabric product without increasing the weight or volume of the woven fabric product as in the conventional art by, for example, using a large amount of the woven fabric, gathering it, and using rubber threads in the woven fabric to make it stretchable or contractible so that the woven fabric pieces can be stretched or contracted.

In order to achieve this object, according to an aspect of the invention, a woven fabric product made of woven fabric pieces cut out of woven fabric into specified shapes and sewn together is provided, wherein the warp and weft directions of the woven fabric are positioned obliquely to the longitudinal direction of the woven fabric pieces.

With the woven fabric product having the above-described construction, the warp and weft directions of the woven fabric are positioned obliquely to the longitudinal direction (or the transverse direction) of the woven fabric pieces. As a result, compared to the case where the warp and weft directions of the woven fabric are parallel to the longitudinal direction (or the transverse direction) of the woven fabric pieces, the woven fabric product having the above-described configuration can be stretched in the longitudinal direction and the transverse direction of the woven fabric pieces. Therefore, when a user wears the woven fabric product, he can move easily in the longitudinal direction and the transverse direction; and when goods are put in the woven fabric product, the inside space of the woven fabric product can be stretched easily in the longitudinal direction and the transverse direction. When the force stretching the woven fabric product is released, the woven fabric product can return to its original state.

According to an embodiment of the invention, the woven fabric pieces can constitute body sections for, for example, a sleeping bag or clothes. When the woven fabric pieces constitute the body sections of a sleeping bag, the sleeping bag is configured so that when the user lies in the sleeping bag, it can stretch easily in the longitudinal direction and the transverse direction (i.e., in the user's body length direction and widthwise direction). Therefore, the shape of the sleeping bag can change in accordance with the user's movement, such as when they turn over in their sleep or change clothes or sit cross-legged inside the sleeping bag. When the woven fabric pieces constitute the body sections of clothes, the clothes can be stretched easily in the user's longitudinal direction and transverse direction (the body length direction and widthwise direction). As a result, the clothes can adequately fit the user's body and easily follow the user's movement.

The woven fabric product according to the invention can be configured so that each of the woven fabric pieces includes a front-side woven fabric piece which is the font side, and a back-side woven fabric piece which is the back side; and a filling having microfibers on its surface is placed between the front-side woven fabric piece and the back-side woven fabric piece. Examples of the filling include feathers and cotton.

Also, the woven fabric product according to the invention can be configured so that the woven fabric is stitched in the warp and weft directions. As a result, when the woven fabric pieces are to stretch, the stitches can prevent this stretch. Also, since the stitches follow stretch of the woven fabric pieces, it is possible to prevent misalignment of the weave patterns of the woven fabric pieces due to the above stretch. Therefore, in addition to the aforementioned advantageous effect, it is possible to prevent the filling (such as feathers or cotton) from coming out of the stitched portions or gaps between the woven fabric warp yarns and weft yarns when the filling is placed between the front-side woven fabric piece and the back-side woven fabric piece.

Moreover, the woven fabric pieces of the woven fabric product according to the invention may be coated. For this coating processing, various resin coatings such as acryl coating, polyurethane coating, PVC coating, silicon coating, or rubber coating can be used. Furthermore, the woven fabric pieces may undergo lamination processing. As a result, in addition to the aforementioned advantageous effects, it is possible to more reliably prevent the filling (such as feathers or cotton) from coming out of the stitched portions and the gaps between the woven fabric warp yarns and weft yarns.

Moreover, the woven fabric for the woven fabric product according to the invention may be ciré-processed. As a result, in addition to the aforementioned advantageous effects, it is possible to make the woven fabric product light and strong and prevent the filling (such as feathers or cotton) from coming out of the stitched portions and the gaps between the woven fabric warp yarns and weft yarns.

Incidentally, the front-side woven fabric or the back-side woven fabric is required to have an appropriate level of air permeability in order to keep bulkiness of the filling as the characteristic of the sleeping bag product. Meanwhile, if the air permeability is too high, the filling may come out of the gaps between the woven fabric warp yarns and weft yarns. So, it is necessary to keep an appropriate level of air permeability. For that purpose, cire finish and air-permeable coating processing are applied to the front-side woven fabric and the back-side woven fabric, which are currently available in the market. It is better to have a sleeping bag product capable of stretching so that it can be used generally comfortably. However, if a woven fabric product that is normally used as a stretching material (such as a woven fabric product using polyurethane covering threads) is used as the sleeping bag product as it is, the aforementioned air permeability will not be kept constant and the filling may often come out of the gaps between the woven fabric warp yarns and weft yarns. Also, if polyurethane covering threads are used, the weight of the sleeping bag product will increase. Measures such as using and gathering a large amount of woven fabric are taken for some sleeping bag products; and also in this case, the weight and volume of the sleeping bag products will increase by using a large amount of woven fabric.

The woven fabric product according to this invention uses woven fabric cut in bias directions, so that it can stretch without increasing the amount of woven fabric to be used (without increasing the weight or volume) and can significantly prevent the filling, which is a heat insulating material, from coming out of the gaps between the woven fabric warp yarns and weft yarns.

With the woven fabric product according to the invention, the warp and weft directions of the woven fabric are positioned obliquely to the longitudinal direction (or the transverse direction) of the woven fabric pieces. As a result, it is possible to provide a woven fabric product whose woven fabric pieces can be stretched in the longitudinal direction and transverse direction of the woven fabric product without increasing the weight or volume of the woven fabric product as in the case of the conventional art by, for example, using and gathering a large (excessive) amount of woven fabric in order to make the woven fabric pieces stretchable and contractible.

DETAILED DESCRIPTION OF PREFERRED EMBODIMENTS

A woven fabric product according to a preferred embodiment of this invention will be described below in detail with reference to the attached drawings. The embodiment described below is for the purpose of describing this invention, but the invention is not limited only to this embodiment. Accordingly, this invention can be utilized in various ways unless the utilizations depart from the gist of the invention.

Figure 1:
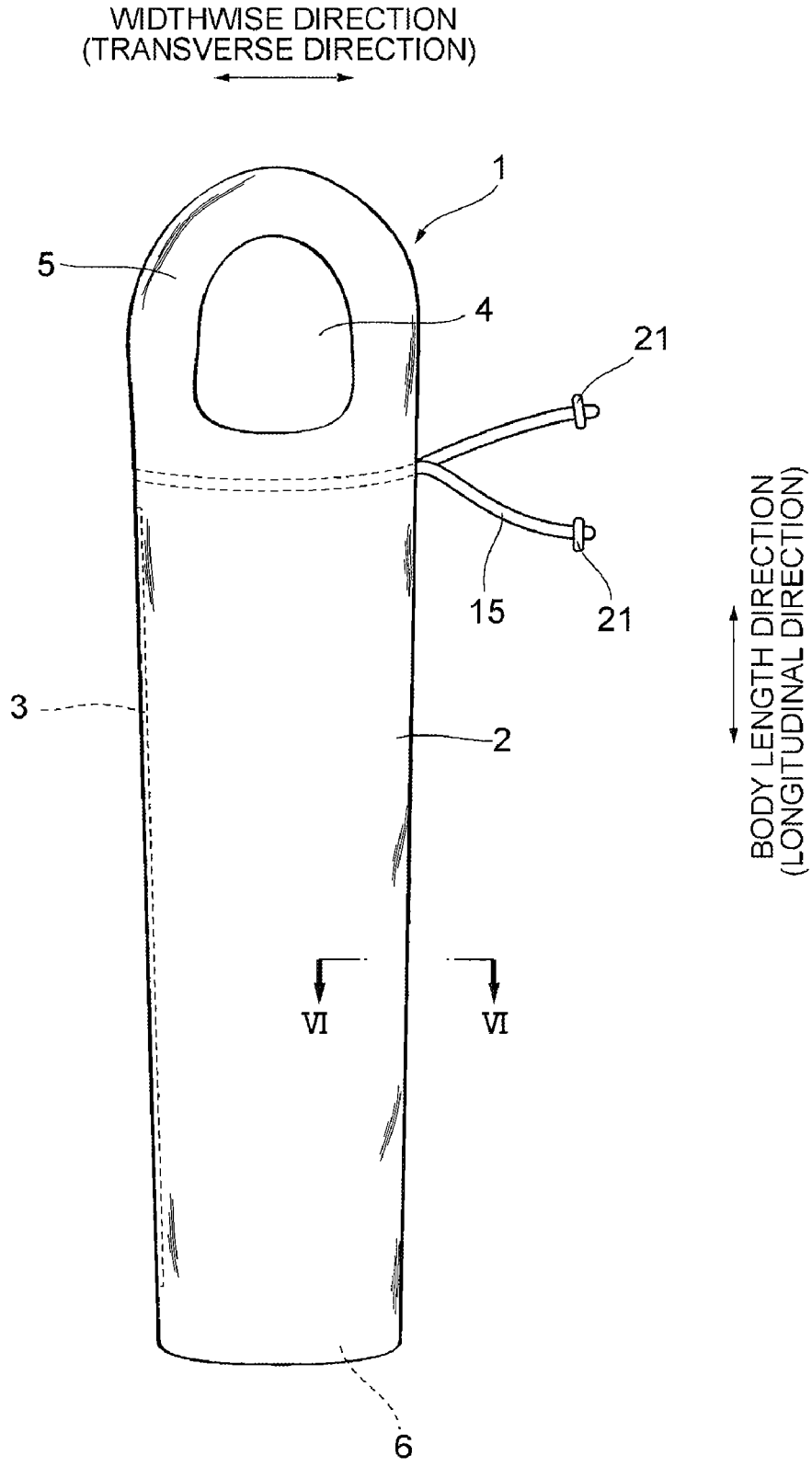
FIG. 1 is a plan view of a woven fabric product according to an embodiment of the present invention.
Figure 2:
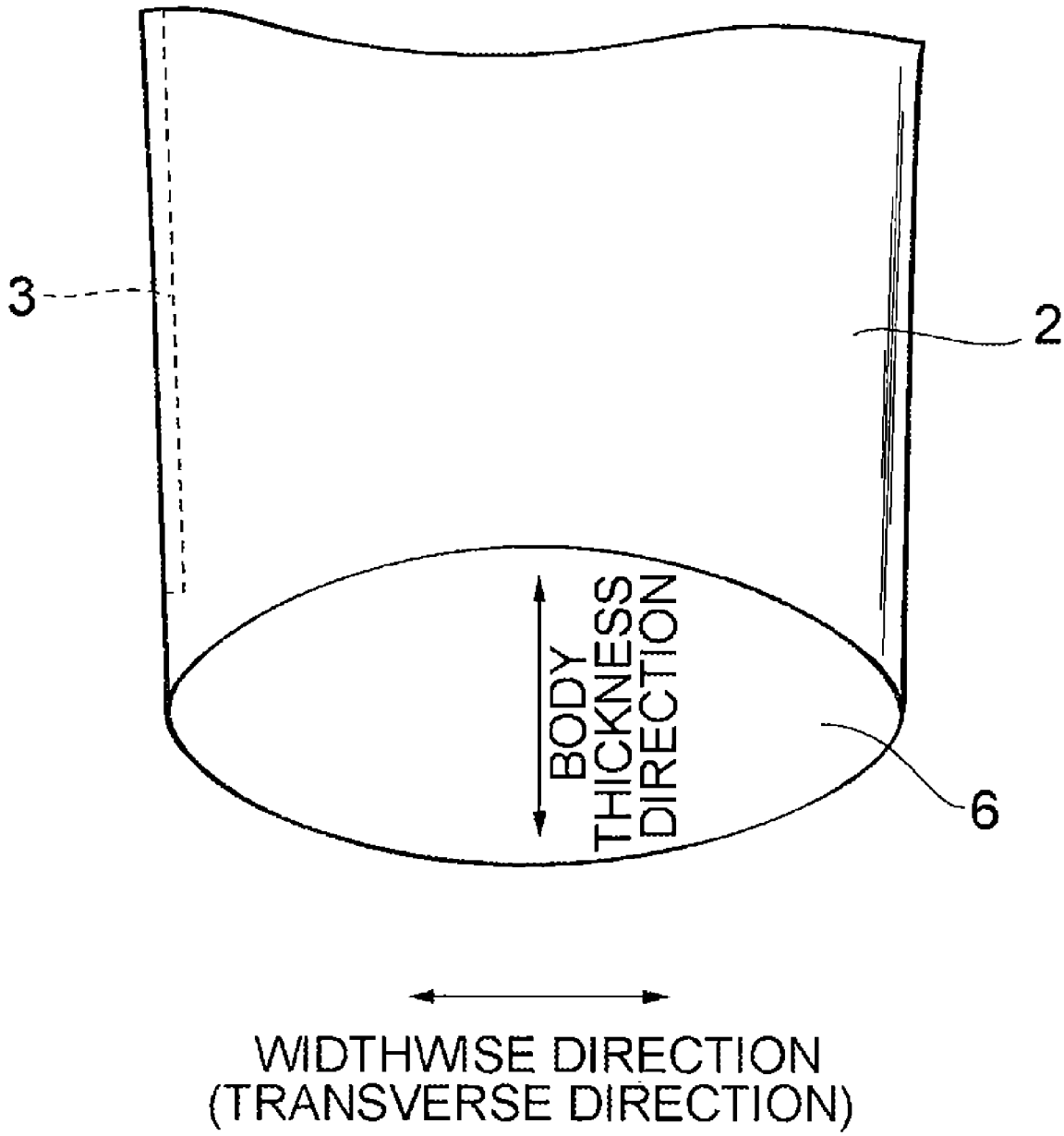
FIG. 2 is a perspective view of part of the woven fabric product in FIG. 1 as seen from its bottom side.
Figure 3:
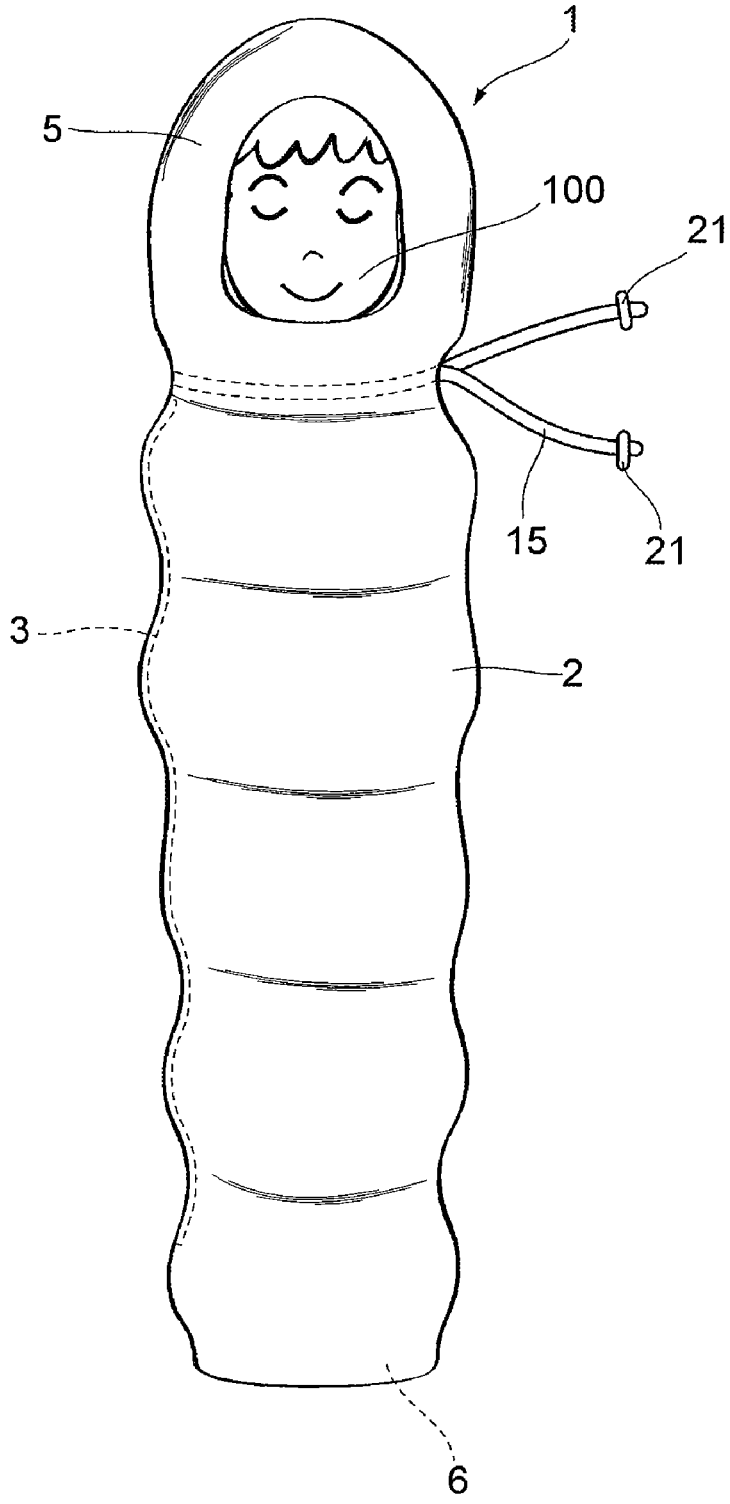
FIG. 3 is a plan view of a user wearing the woven fabric product in FIG. 1 and lying supine.
Figure 4:
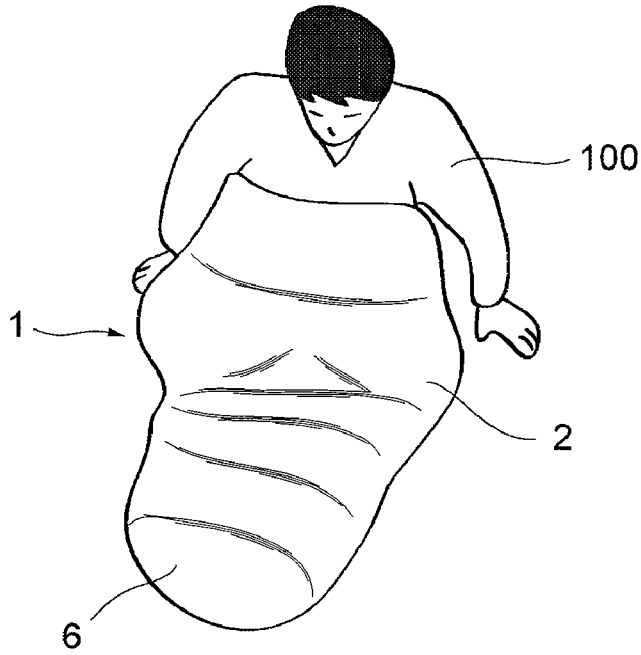
FIG. 4 is a perspective view of a user wearing the woven fabric product in FIG. 1 and sitting cross-legged.
Figure 5:
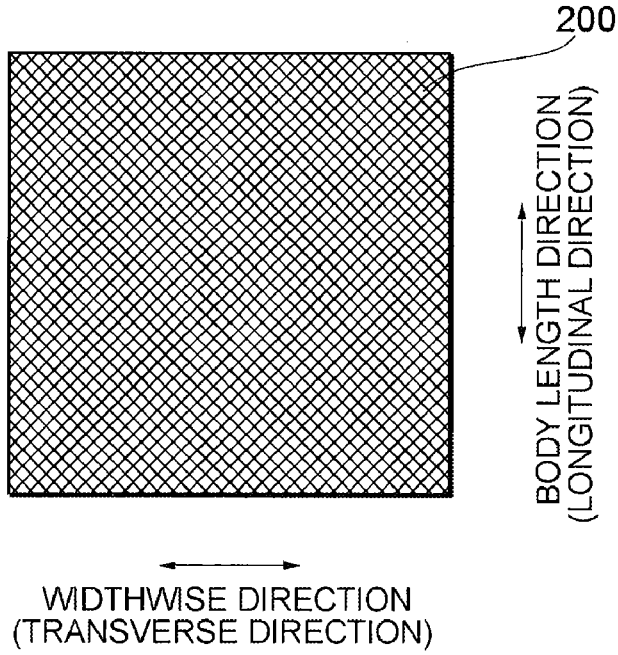
FIG. 5 is an enlarged plan view of the woven fabric product in FIG. 1, showing the longitudinal and transverse directions of the woven fabric product and the warp and weft directions of the woven fabric.
Figure 6:
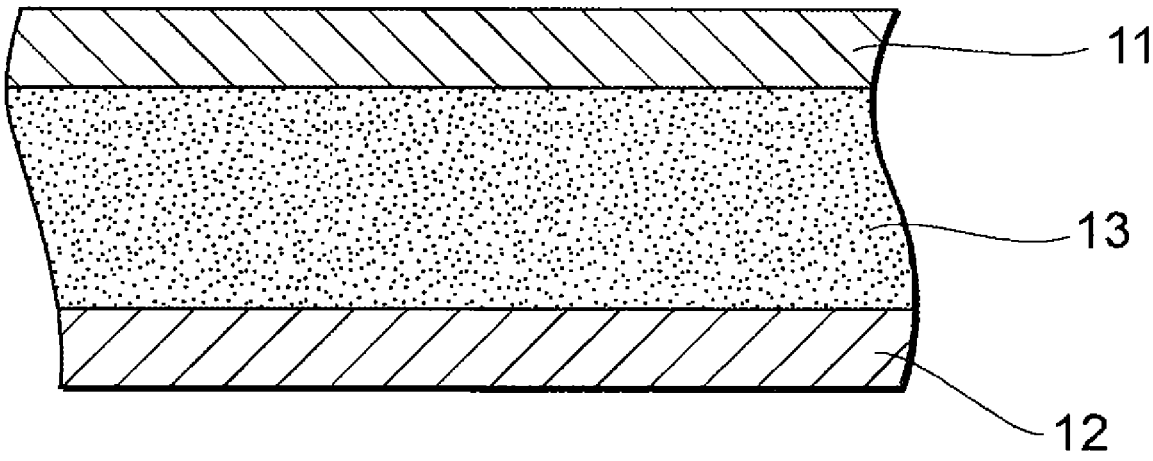
FIG. 6 is a cross-sectional view of the woven fabric product as taken along line VI-VI in FIG. 1.

FIG. 1 is a plan view of a woven fabric product according to an embodiment of the present invention. FIG. 2 is a perspective view of part of the woven fabric product in FIG. 1 as seen from its bottom side. FIG. 3 is a plan view of a user wearing the woven fabric product in FIG. 1 and lying supine. FIG. 4 is a perspective view of a user wearing the woven fabric product in FIG. 1 and sitting cross-legged. FIG. 5 is an enlarged plan view of the woven fabric product in FIG. 1, showing the longitudinal and transverse directions of the woven fabric product and the warp and weft directions of the woven fabric. FIG. 6 is a cross-sectional view of the woven fabric product as taken along line VI-VI in FIG. 1. Incidentally, each of the above drawings illustrates the thickness, size, enlargement and reduction ratios, and other details of each component; but for ease of comprehension, they are not to scale.

As shown in FIGS. 1 to 6, a woven fabric product 1 according to an embodiment of the invention is, for example, a sleeping bag that includes: a main body 2 that forms a long inside space for placing the user 100's body and keeps the inside space warmer than the outside air; an opening/closing zipper 3 that is placed on the main body 2 and can open or close an opening to the inside space from both outside and inside the sleeping bag; a hood portion 5 that covers the user 100's head and has an opening 4 for exposing the user 100's face when they lie in the sleeping bag; and a bottom portion 6 that covers the user 100's feet when they lie in the sleeping bag.

As shown in FIG. 6, the main body 2, the hood portion 57 and the bottom portion 6 are composed of: a front-side woven fabric piece 11 that forms the outer surface of the woven fabric product 1; a back-side woven fabric piece 12 that forms the inside surface of the woven fabric product 1; and a filling 13 that is feathers, cotton, and the like filled in the space surrounded by the front-side woven fabric piece 11 and the back-side woven fabric piece 12.

The front-side woven fabric piece 11 and the back-side woven fabric piece 12 which form the main body 2 and the hood portion 5 are aligned so that when the user 100 wears the woven fabric product 1, the warp and weft directions of the weave patterns 200 are positioned obliquely (at an approximately 45-degree angle in this embodiment) to the user 100's body length direction (longitudinal direction) and widthwise direction (transverse direction) as shown in FIG. 5. As a result, the main body 2 and the hood portion 5 can easily stretch in the user 100's body length direction and widthwise direction. Therefore, the weight and volume of the woven fabric will not increase unnecessarily as a result of, for example, using and gathering a large amount of woven fabric in order to make the front-side woven fabric piece 11 and the back-side woven fabric piece 12 stretchable and contractible. Consequently, the woven fabric product 1 is light and compact and convenient for portable use and storage and the amount of woven fabric to be used can be reduced, so that the prices can be restrained.

The bottom portion 6 is located at one end of the main body 2 opposite the hood portion 5 at the other end. The front-side woven fabric piece 11 and the back-side woven fabric piece 12 that constitute the bottom portion 6 are aligned so that when the user 100 wears the woven fabric product 1, the warp and weft directions of the weave patterns 200 (see FIG. 5) of the front-side woven fabric piece 11 and the back-side woven fabric piece 12 are positioned obliquely (at an approximately 45-degree angle in this embodiment) to the user 100's widthwise direction and body thickness direction as shown in FIG. 2. As a result, the bottom portion 6 can easily stretch in the user 100's widthwise direction and body thickness direction.

Furthermore, a laminated structure composed of the front-side woven fabric piece 11, the filling 13, and the back-side woven fabric piece 12 may be quilted. If the front-side woven fabric piece 11 and the back-side woven fabric piece 12 are quilted in the warp and weft directions of the weave patterns 200, when the front-side woven fabric piece 11 and the back-side woven fabric piece 12 are to stretch, it is possible to prevent the quilting (stitches) from blocking the stretch of the front-side woven fabric piece 11 and the back-side woven fabric piece 12. It is also possible to prevent the filling 13 from coming out of needle holes of the quilting stitches.

As shown in FIGS. 1 and 3, a string (draw cord) 15 is placed around the boundary area between the main body 2 and the hood portion 5 corresponding to the user's neck. The woven fabric product 1 can be made to fit the user's neck by tying the string 15, and it is possible to prevent heat from escaping from the user's neck. Also, a stopper 21 for keeping and fixing the string 15 tied up is provided at both ends of the string 15.

Incidentally, with the woven fabric product 1, a string (draw cord) (not shown in the drawing) may be located near the opening 4 in the hood portion 5; and the size of the opening 4 can be reduced by tying this string so that the hood portion 5 will be in close contact with the area near the user's face line.

When the user 100 wears the woven fabric product 1 having the above-described configuration, the main body 2 and the hood portion 5 stretch in the user 100's body length direction and widthwise direction as described above. As a result, when the user 100 lies supine as shown in FIG. 3, they will not feel cramped or bothered when, for example, turning over in their sleep. Therefore, the user 100 can have a good and comfortable sleep. They can also change their clothes in the woven fabric product 1. Also, the user 100 can easily move as they desire, for example, to sit cross-legged as shown in FIG. 4. Incidentally, the user 100 can move with the hood portion 5 covering their head to, for example, sit cross-legged.

Any type of woven fabric can be used for the front-side woven fabric piece 11 and the back-side woven fabric piece 12 as long as it is woven fabric (textile). If a laminated structure composed of the front-side woven fabric piece 11, the filling 13, and the back-side woven fabric piece 12 is used to form the woven fabric product 1, a woven fabric (front-side woven fabric piece 11 and back-side woven fabric piece 12) which has undergone ciré finish or coating processing may be used so that it is possible to prevent the filling 13 from coming out of, for example, the stitched portions.

This embodiment has described a sleeping bag as an example of the woven fabric product 1. However, the invention is not particularly limited to this example, and the woven fabric product 1 may be, for example, clothes, sleeping bag covers, or bags for storing goods. Therefore, it is only necessary for the woven fabric pieces which constitute each woven fabric product to be aligned so that the warp and weft directions of the woven fabric are positioned obliquely to the longitudinal direction (or transverse direction) of the woven fabric pieces.

This embodiment has also described the case where the warp and weft directions of the weave patterns 200 of the front-side woven fabric piece 11 and the back-side woven fabric piece 12 which constitute the main body 2 and the hood portion 5 are inclined at an approximately 45-degree angle to the user 100's body length direction (longitudinal direction) and width direction (transverse direction), and the warp and weft directions of the weave patterns 200 of the front-side woven fabric piece 11 and the back-side woven fabric piece 12 which constitute the bottom portion 6 are inclined at an approximately 45-degree angle to the user 100's widthwise direction and body thickness direction. However, the invention is not limited to this example, and the inclination angle can be decided as appropriate.

Furthermore, this embodiment has described the case where the woven fabric product 1 is made of a laminated structure composed of the front-side woven fabric piece 11, the filling 13, and the back-side woven fabric piece 12. However, the invention is not limited to this example, and the woven fabric product 1 may be made by sewing single-layer woven fabric pieces.

What is claimed is:

1. A woven fabric product comprising woven fabric pieces cut out of woven fabric into specified shapes and sewn together to form the woven fabric product, the woven fabric pieces having a longitudinal direction, wherein the longitudinal direction of the warp and weft of the woven fabric are oblique to the longitudinal direction of the woven fabric pieces, wherein the woven fabric product is a sleeping bag, wherein the woven fabric pieces constitute body sections of the sleeping bag, wherein the body sections of the sleeping bag include a main body, wherein the woven fabric pieces constituting the main body include a front-side woven fabric piece and a back-side woven fabric piece, the front-side woven fabric piece forming an outer surface of the sleeping bag and the back-side woven fabric piece forming an inside surface of the sleeping bag, wherein a filling having microfibers on its surface is placed between the front-side woven fabric piece and the back-side woven fabric piece, and wherein the main body has a body length direction corresponding to the longitudinal direction of the woven fabric pieces.

2. The woven fabric product according to claim 1, wherein the body sections of the sleeping bag further include a bottom portion located at one end of the main body, the bottom portion having a widthwise direction and a body thickness direction, wherein the longitudinal direction of the warp and weft of the woven fabric of the woven fabric pieces constituting the bottom portion are oblique to the widthwise direction and the body thickness direction of the bottom portion.

* * * * *